United States Patent [19]

Paxton

[11] 3,935,798

[45] Feb. 3, 1976

[54] CONTAINER ASSEMBLING MACHINE

[75] Inventor: Gerald C. Paxton, Sanger, Calif.

[73] Assignee: SWF Machinery, Inc., Sanger, Calif.

[22] Filed: Feb. 4, 1974

[21] Appl. No.: 439,145

[52] U.S. Cl. ..... 93/39 R; 93/36.01; 93/51 R; 93/55; 93/53 SD

[51] Int. Cl.[2] ..... B31B 17/74; B31B 17/02

[58] Field of Search ..... 93/36.01, 39 R, 55, 49 R, 93/51 R, 47, 53 R, 53 SD

[56] References Cited

UNITED STATES PATENTS

| | | | |
|---|---|---|---|
| 3,613,525 | 10/1971 | Lense et al. | 93/53 SD |
| 3,659,505 | 5/1972 | Wasyluka et al. | 93/39 R X |
| 3,673,928 | 7/1972 | Striplin | 93/55 X |
| 3,741,082 | 6/1973 | Sorensen et al. | 93/53 SD X |
| 3,814,000 | 6/1974 | Heisler | 93/53 SD |

*Primary Examiner*—James F. Coan
*Attorney, Agent, or Firm*—Huebner & Worrel

[57] ABSTRACT

A container assembling machine operable successively to form and insert first container components into second container components at an assembly station to form containers, the machine having as an integral part or as an attachment a second component ready station adjoining the assembly station; a second component grasping arm reciprocally mounted on the machine for movement between the ready station and the assembly station; first component inserting members pivotally mounted on the machine in introducing relation to a second component in the assembly station; a container discharge arm pivotally mounted on the machine for movement through the assembly station; and a synchronous drive mechanism operably interconnecting the machine and the grasping and discharge arms for fully automatic sequential assembly and discharge of containers from the machine. The invention is suitable for embodiment in auxiliary attachments for existing container assembling machines.

22 Claims, 7 Drawing Figures

CONTAINER ASSEMBLING MACHINE

BACKGROUND OF THE INVENTION

The present invention relates to a container assembling machine and more particularly to an improvement in such a machine which operates with maximum dependability to position the components of a container for assembly in an assembly station and to eject the container from the assembly station subsequent to such assembly without manual assistance and without auxiliary power.

The applicant is the patentee of several patents on container forming machines and portions thereof. Among these are U.S. Pat. No. 3,590,700 entitled "Method and Machine For Forming Containers"; U.S. Pat. No. 3,611,885 entitled "Improved Compressing Apparatus For Container Forming Machine"; and U.S. Pat. No. 3,618,792 entitled "Mat Feeding Magazine", as well as several currently pending patent applications relating to the applicant's project of refining and improving container forming methods and apparatus from which the present invention evolved.

A variety of container forming machines have been developed for assemblying specific types of containers. Commonly, such containers, regardless of their specific form, are constructed from a pair of components which are individually formed in the machine and then assembled to form the container. For example, one such container formed by this method of construction is commonly known as the "full telescoping container". The construction of this type of container calls for the formation of a first tray component and the insertion of the component into a second lid component. Subsequently, the flaps of the lid component are sealed so that the lid component forms a lid or cover for the container.

Conventional container forming machines utilizing this method of assembly suffer from onerous deficiencies which detract from their otherwise efficient operation. Subsequent to individual assembly, the components must be positioned in nearly precise alignment for proper uniting of the components to form the container. Conventionally, such alignment must be manually performed by aligning one of the components with the other in an assembly station. Subsequent to such alignment, the machine inserts one component in the other. The assembled container is then manually ejected from the assembly station to make room for the assembling of the next container. No practical and fully dependable apparatus for fully automatic assembly of the components in the assembly station has heretofore been available. The manual manipulation described is not only onerous, monotonous and wasteful of manpower, but it is also expensive. Furthermore, the monotony involved in the operation contributes to unreliable performance and a considerable percentage of defectively formed containers.

Therefore, it has long been recognized that it would be desirable to provide a container assembling machine which is adapted to obviate the necessity for manual manipulation of container components during assembling by automatically orienting and assembling the components to form the containers and ejecting the containers from the machine and which is operated by the existing power system of the machine without requiring an auxiliary source of power.

SUMMARY OF THE INVENTION

Accordingly, it is an object of the present invention to provide improved container assembling machines.

Another object is to provide such a machine or attachment which obviates the necessity for manual assistance in the assembly of containers by existing machines.

Another object is to provide such a machine or attachment which reduces the expense incurred in operating conventional container assembling machines.

Another object is to provide such a machine or attachment which operates automatically to orient container components relative to each other for assembly into a container.

Another object is to provide such a machine or attachment which positions one component of the container in receiving relation to a second component during assembly.

Another object is to provide such a machine or attachment which insures proper erection of a folded component in a container assembly station.

Another object is to provide such an attachment which is driven by the existing power source of the machine on which the attachment is mounted without requiring an auxiliary source of power.

Another object is to provide such a machine or attachment which reacts cooperatively during insertion of one component into another dependably to guide such insertion.

Another object is to provide such a machine or attachment which operates to reduce to an absolute minimum the number of defectively assembled containers produced by existing machines.

A further object is to provide such a machine or attachment which operates automatically, sequentially to eject assembled containers subsequent to assembly.

Still further objects and advantages are to provide improved elements and arrangements thereof in an apparatus for the purposes described which is dependable, economical, durable and fully effective in accomplishing its intended purposes.

DESCRIPTION OF THE PREFERRED EMBODIMENT

The device of the present invention is adapted to be mounted on a variety of types of container assembling machines. Representative types of container assembling machines and portions thereof are disclosed by the applicant's aforementioned U.S. Pat. Nos. 3,590,700; 3,611,885; and 3,618,792. As will become apparent, the present invention is adaptable for use on a wide variety of container assembling machines as an integral component or as an auxiliary attachment. The form of the assembling machine illustrated in this application is shown for illustrative convenience and constitutes a suitable environment for the invention.

Figure 1:
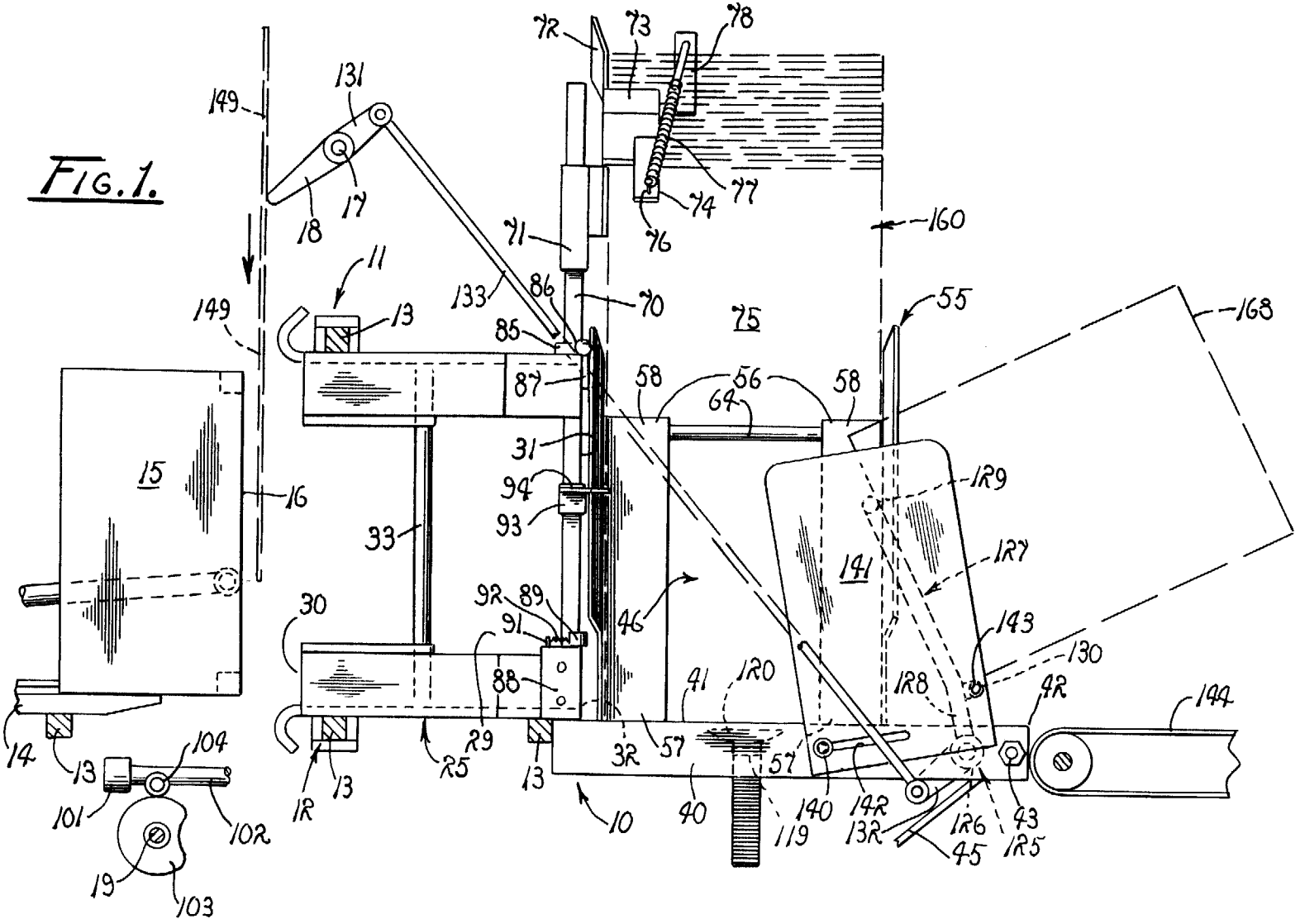
FIG. 1 is a fragmentary side elevation of a container assembling machine embodying the priciples of the present invention and showing the discharge arm thereof positioned in a container discharging position.
Figure 3:
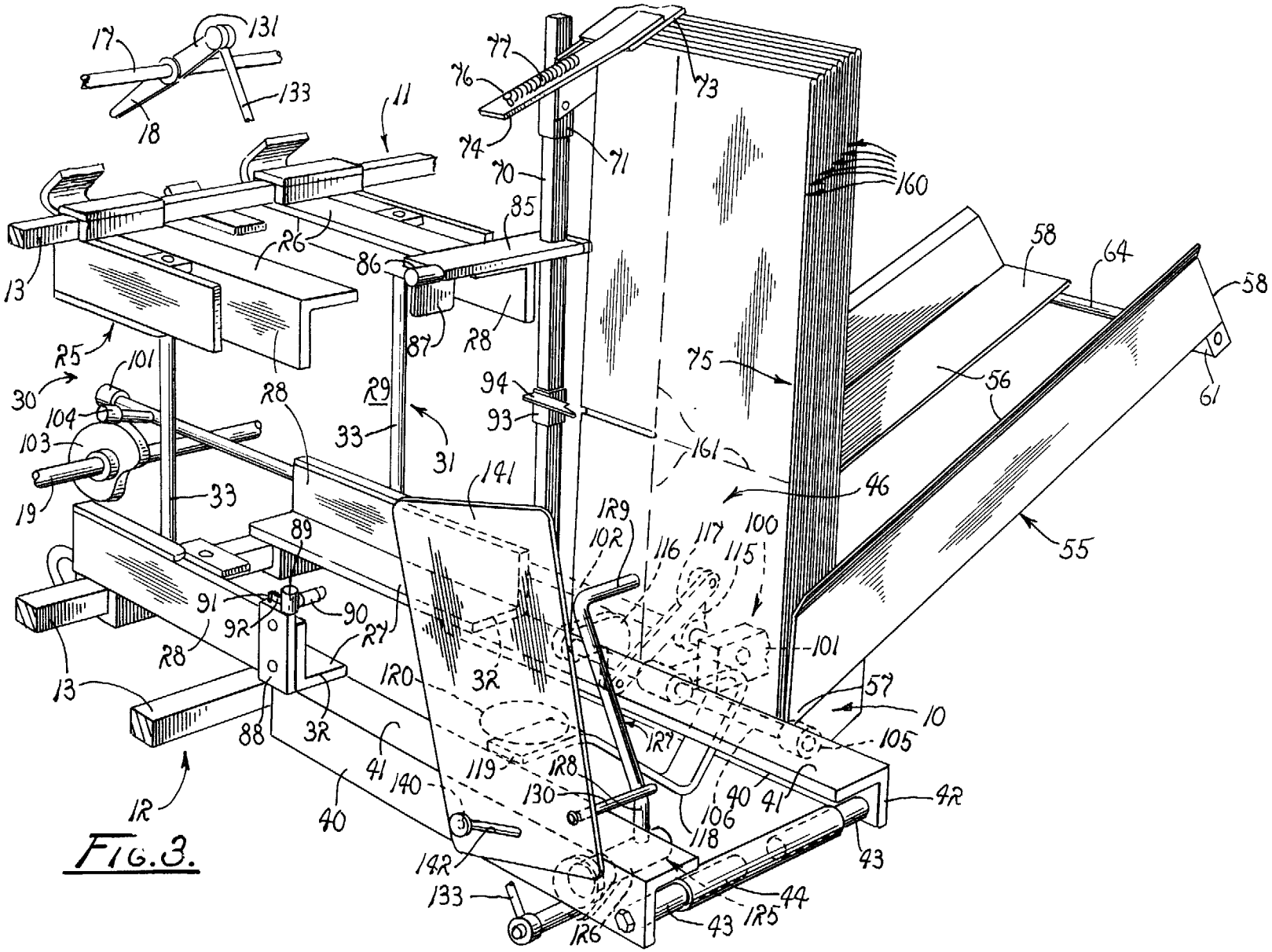
FIG. 3 is a fragmentary perspective view of the machine shown in FIG. 1.
Figure 4:
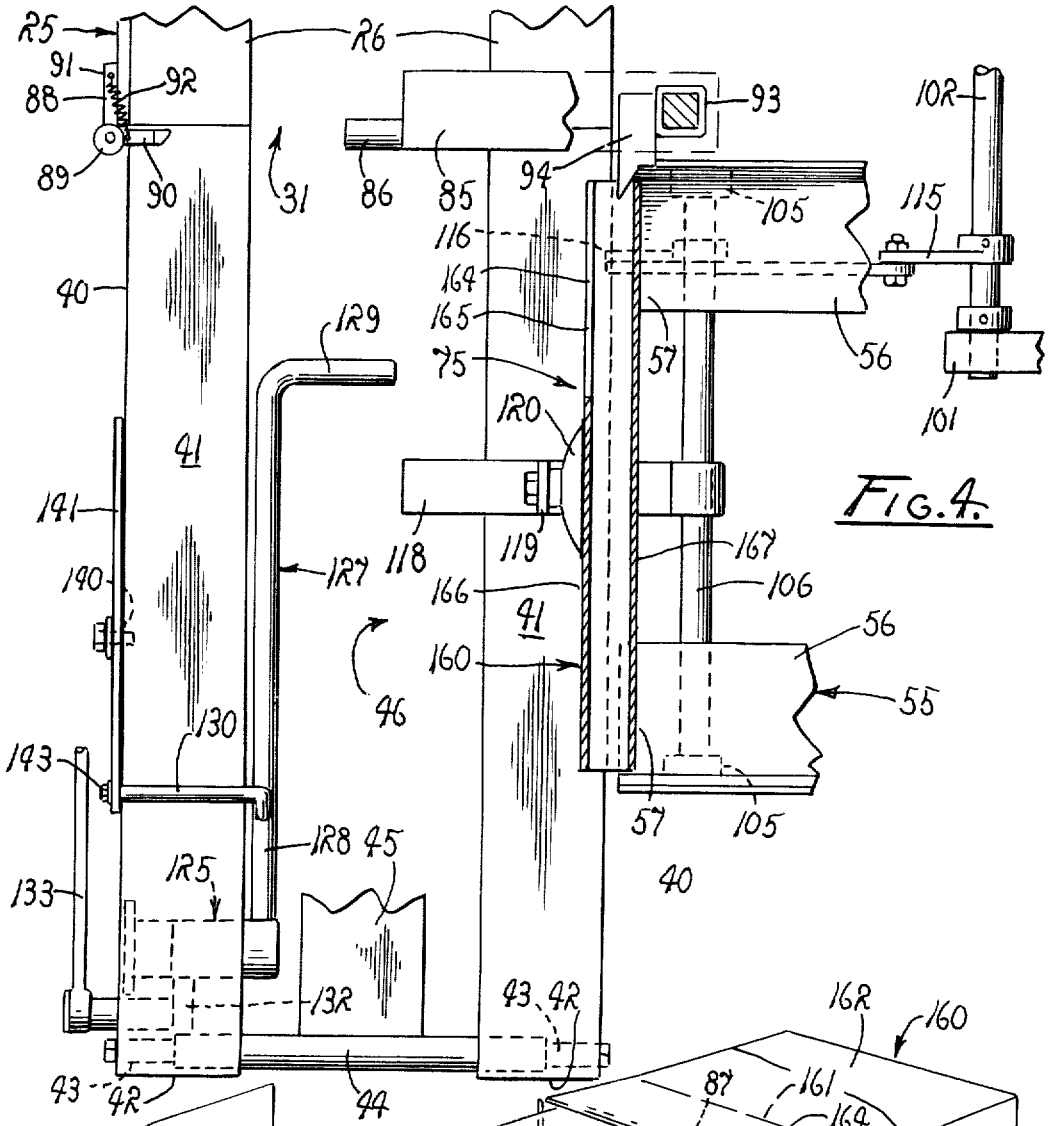
FIG. 4 is a somewhat enlarged fragmentary top plan view of the machine.

The improvement of the present invention is generally represented by the numeral 10 in FIG. 3. A representative container assembling machine is generally indicated by the numeral 11. The machine shown fragmentarily in the drawings and described herein is somewhat similar to that disclosed in detail in the applicant's U.S. Pat. No. 3,590,700 and specific reference is made to that patent for further structural and operational disclosure of the machine. The machine has a rigid metal frame 12 composed, in part, of horizontal transverse frame members 13. Longitudinal guide rails 14, fragmentarily shown in FIG. 1, are mounted on selected transverse frame members. A mandrel assembly 15 is borne by the guide rails and is adapted to be reciprocally thrust along a rectilinear path of travel substantially normal to the transverse frame members. The assembly has a blank contacting surface 16 disposed substantially normal to the path of travel. The machine operably mounts a first sequence or upper drive shaft 17 adapted to be reciprocated rotationally about its longitudinal axis in a predetermined sequence for purposes subsequently to be described. A blank release arm 18 is affixed on the shaft in substantially right angular relation thereto. The upper drive shaft and release arm operate in cooperation with a blank magazine, not shown, as will subsequently be described. The second sequence or lower drive shaft 19 is mounted in the machine below the mandrel assembly substantially parallel to the upper drive shaft.

A die assembly 25 is mounted on the transverse frame members 13 of the machine 11 in alignment with the path of travel of the mandrel assembly 15. The die assembly is composed of a pair of spaced, substantially parallel upper die plates 26 and a pair of spaced, substantially parallel lower die plates 27 horizontally adjustably mounted on selected transverse frame members 13. Each of the upper and lower die plates mounts a side die plate 28 disposed substantially normally thereto so as to form a box-like interior or chamber 29 for the die assembly. The die assembly has a substantially rectangular entrance opening 30 and an opposite substantially rectangular discharge opening 31. The lower die plates have discharge ends 32 bounding the discharge opening of the die assembly. A pair of brace members 33 interconnect corresponding upper and lower die plates to maintain the die assembly in the configuration described.

A pair of spaced, substantially parallel angle iron members 40, having upper surfaces 41 and remote ends 42, are mounted in substantially horizontal relation on the lower die plates 27 of the die assembly 25 extending endwardly from the discharge openings 31 thereof. The angle iron members are thus horizontally adjustable to and from each other with their respective lower die plates. The members are mounted beneath the discharge ends of the lower die plates so as to form a step-down configuration, as best shown in FIG. 3. A pair of shafts 43 are affixed on the remote ends of the angle iron members extending toward each other in axial alignment. A sleeve 44 is slidably mounted thereon. A brace 45 is secured on and extends upwardly, diagonally from the frame 12 of the machine 11 and is fastened at its remote end to the sleeve in supporting relation to the remote ends of the angle iron members. The angle iron members and the die assembly thus define a container assembly position or station 46 above the members and rearwardly of the die assembly. As will subsequently be seen, the mandrel and die assembly operate to thrust first container components along a path of travel through the die assembly and into the assembly station.

Figures 2, 7:
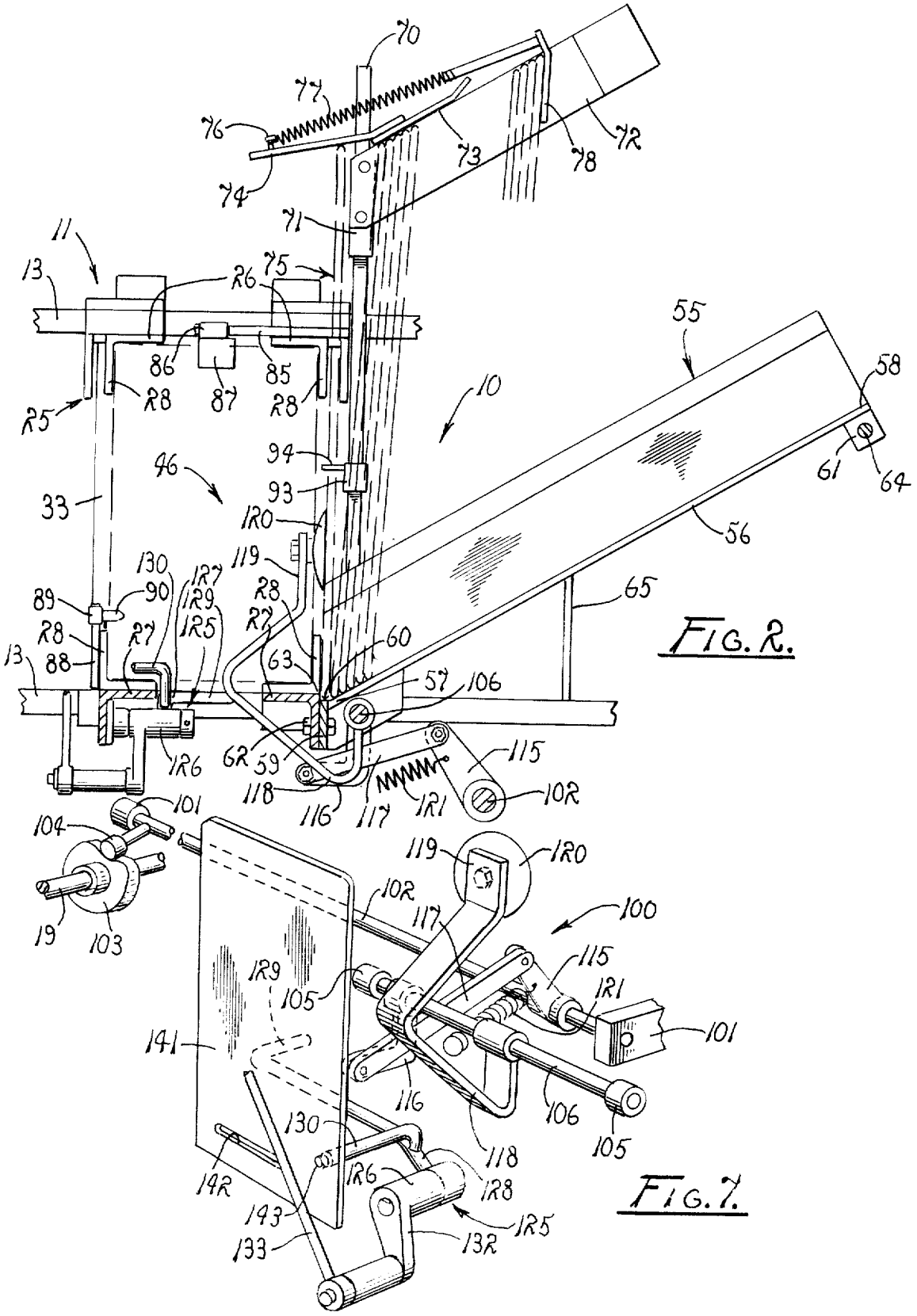
FIG. 2 is a fragmentary rear elevation of the machine shown in FIG. 1 and showing the grasping arm in a raised position.
FIG. 7 is a fragmentary perspective view of a drive mechanism of the machine.

The container assembly machine 11 mounts a second component feeding magazine 55 thereon, as best shown in FIGS. 2 and 3. The magazine is somewhat similar to that disclosed by the applicant's aforementioned U.S. Pat. No. 3,618,792, but modified by the improvement of the present invention, as will subsequently be seen. The magazine has a pair of feed ramps 56 having lower ends 57 and opposite upper ends 58. A mounting bracket 59 is individually secured on each of the ramps immediately adjacent to the lower end thereof and extending downwardly therefrom. Each of the brackets has an upper edge 60 which meets its respective feed ramp, as shown in FIG. 2. A flange 61 is mounted adjacent to the upper end of each ramp extending downwardly therefrom. The mounting brackets 59 are secured by bolt assemblies 62 on the angle iron member 40, as shown in FIG. 2, so as to mount the upper edge of the brackets and the lower ends of the ramps slightly below the upper surface 41 of the member so that the member forms a raised component retaining lip 63 with respect thereto. The ramps extend diagonally upwardly therefrom, as best shown in FIG. 2. A rod 64 is received through the flanges 61 to interconnect the ramps, as shown in FIGS. 2 and 3. It will be noted that the ramps are mounted on the angle iron member so that they may be adjusted to and from each other by repositioning of the bolt assemblies and brackets to accommodate components of a variety of widths, as will subsequently be seen. Each of the ramps mounts a downwardly extending support 65 which is secured on the frame 12 of the machine in supporting relation to the ramps.

The improvement 10 of the present invention includes a mounting bar 70 secured in upstanding relation on the frame 12 of the machine 11 immediately adjacent to the adjoining angle iron member 40 and feed ramp 56. The bar mounts a bracket 71 thereon in predetermined spaced relation to the lower ends 57 of the ramps. A guide plate 72 is affixed on the bracket extending diagonally upwardly therefrom substantially parallel to the feed ramps and disposed in a substantially vertical plane, as best shown in FIG. 2. A confining plate 73 is edgewardly, right angularly borne by the guide plate substantially parallel to the lower end of the adjacent ramp. The plate is spaced a predetermined distance to the right, as viewed in FIG. 2, of vertical alignment with the lower end of the ramps. A guide arm 74 is fastened on the confining plate 73 and extends diagonally, downwadly therefrom over the assembly station 46 to define an upper boundary for component travel as will subsequently be seen. The lower ends of the feed ramps, upper edge of the brackets, raised lip 63, confining plate and guide arm define a second component ready station 75. A spring pin 76 is mounted adjacent to the remote end of the guide arm. A tension spring 77 is affixed on the spring pin at one of its ends and mounts an angular control finger 78 at the other of its ends, for purposes subsequently to be described.

The improvement 10 further includes an upper mounting plate 85 mounted at one of its ends on the bar 70. The mounting plate is fastened, adjacent to the other of its ends, on the adjacent upper die plate 26 so as to extend horizontally from the bar, as shown in FIG. 3. The mounting plate has a horizontal bushing 86 endwardly mounted at the remote end thereof above the discharge opening 31 of the die assembly 25. A guide member or flap 87 is pivotally mounted on the bushing so as gravitationally to be suspended therefrom. A lower mounting plate 88 is secured on the side die plate 28 of the die assembly remote from the bar 70 in substantially vertical attitude. A vertical bushing 89 is endwardly mounted on the lower mounting plate extending upwardly therefrom. A guide member or finger 90 is pivotally mounted on the vertical bushing so as to permit rotation from a normal position extending transversely of the discharge opening of the die assembly to an extended position extending substantially parallel to the path of travel defined by the die assembly. A spring pin 91 is endwardly affixed on the lower mounting plate in spaced relation to the vertical bushing 89. A tension spring 92 interconnects the spring pin and the guide finger so as to maintain the guide finger in the normal position shown in FIG. 3. A bracket 93 is mounted on the bar 70 in downwardly spaced relation from the upper mounting plate 85. A flat stop finger 94 is affixed at a predetermined elevation on the bracket 93 so as to define a substantially horizontal plane and extending into the ready station 75 above the lower end 57 of the adjacent feed ramp 56.

Figure 6:
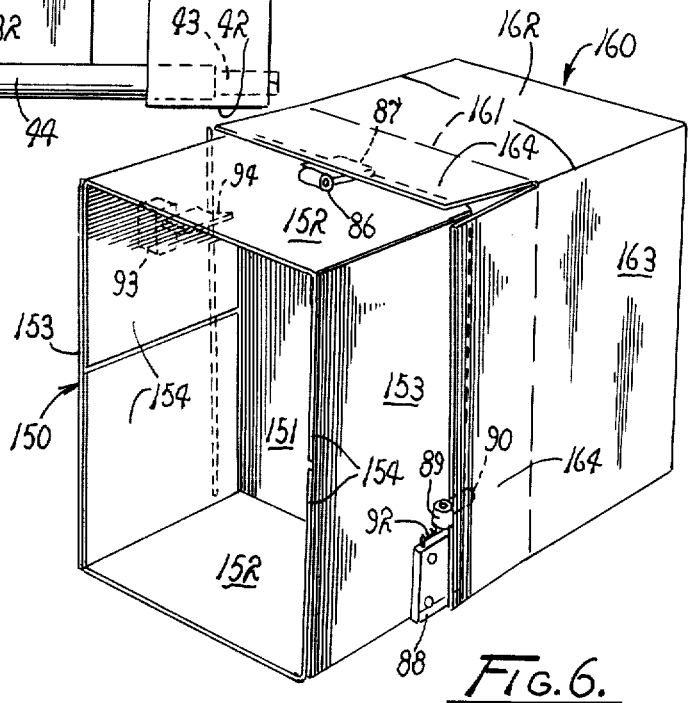
FIG. 6 is a perspective view of first and second container components disposed in their operative relationship with respect to the top finger and guide members of the present invention.

The improvement 10 includes a drive mechanism 100, best shown in FIGS. 3 and 6. It will be apparent that a variety of types of drive mechanisms could be employed without departing from the scope of the invention. However, it will be seen that the drive mechanism herein shown and described has numerous operative advantages. The drive mechanism has a pair of bearing mounts 101 secured on the frame 12 of the container assembly machine 11 in spaced relation so as to define an axis of rotation extending substantially normal to the lower drive shaft 19 of the machine from a position adjacent to and above the lower drive shaft to a position laterally disposed with respect to the container assembly station 46. A power take off shaft 102 is rotationally mounted in the bearing mounts. An eccentric or cam wheel 103 is borne by the lower drive shaft 19 adjacent to the power take off shaft. A cam follower 104 is mounted in fixed relation on the power take off shaft for rested edgeward engagement with the cam wheel. A pair of second bearing mounts 105 are secured in spaced relation on the frame 12 of the assembly machine 11 so as to define an axis of rotation extending parallel to the power take off shaft adjacent to the container assembly station 46 and below the component feeding magazine 55. A power transfer shaft 106 is rotationally mounted in the pair of second bearing mounts so as to extend therebetween.

A lever arm 115 is fastened in a predetermined fixed position on the power take off shaft 102 adjacent to the container assembly station 46. An angled throw arm 116 is mounted in fixed position on the power transfer shaft 106 in alignment with the lever arm 115. A linking rod 117 is pivotally mounted on and interconnecting the remote ends of the lever arm 115 and throw arm 116. A grasping member or arm 118, having a remote end portion 119, is mounted in fixed relation on the power transfer shaft 106. The end portion of the grasping arm mounts a vacuum cup 120. As shown best in FIGS. 2 and 6, a tension spring 121 is connected at one of its ends to the frame 12 of the machine spaced from the drive mechanism 100 and at the other of its ends to the lever arm 115. The spring thus resiliently urges the power take off shaft 102 in a counterclockwise direction as viewed in FIG. 2 to retain the cam follower 104 at the other end thereof in engagement with the cam wheel 103. The cam wheel 103, cam follower 104, lever arm 115, throw arm 116, and grasping arm 118, are positioned so that rotation of the lower drive shaft 19 of the assembly machine 11 is adapted sequentially, reciprocally to motivate the end portion of the grasping arm between a raised wall engaging position shown in FIG. 2 in which the cup is in the ready station 75 and a retracted component erecting position shown in FIG. 3 in which the cup is positioned centrally of and below the container assembly station 46.

An arm mounting assembly 125 is secured on the angle iron member 40 farthest from the feeding magazine 55 and extending toward the magazine below the container assembly station 46, as best shown in FIG. 2. A sleeve 126 is rotationally mounted on the assembly. A container discharge arm 127 is secured on the sleeve. The discharge arm has an angled portion 128 adjacent to the sleeve and a right angularly bent end portion 129. An angled rod 130 is laterally extended from the angled portion of the discharge arm for rested engagement with the upper surface 41 of the angle iron member 40. A lever arm 131 is affixed on the blank release arm 18 of the upper drive shaft 17, as best shown in FIG. 1. A control linkage 132 is secured on the sleeve 126 so as to extend below the angle iron member 40 and laterally thereof. The lever arm 131 and throw assembly 132 are operable interconnected by a linking rod 133 extending therebetween, as best shown in FIG. 1.

A pin 140 is affixed on the angle iron member 40 mounting the discharge arm 127 extending outwardly therefrom in a predetermined position. A guide panel 141, having a slot 142 disposed therein in a predetermined position, is mounted on the angle iron member 40 in upstanding relation with the pin 140 extended through the slot 142. The panel is connected to the remote end of the rod 130 by a pivotal connection 143 so as to interconnect the panel and the discharge arm, as best shown in FIG. 3. As shown fragmentarily in FIG. 1, a conveyor 144 is positioned adjacent to the remote ends 42 of the angle iron members. The conveyor is adapted, in the conventional manner, to transport assembled containers from the container assembly station 46 along an assembly line for subsequent handling.

A first component blank 149 is shown in dashed lines in FIG. 1. The container assembly machine 11 is adapted successively to form the blanks into trays or first container components generally indicated by the numeral 150 in FIG. 6. This is accomplished by sequentially thrusting the mandrel assembly 15 against the blank and into the die assembly 25 for folding of the blank about a mandrel to form the component. As shown in FIG. 6, such components have a bottom wall 151, opposite end walls 152 and side walls 153. A pair of flap portions 154 are individually, endwardly extended from each end wall and in adhesive engagement with the side walls of the component to retain the first components in the configuration shown in FIG. 6.

Figure 5:
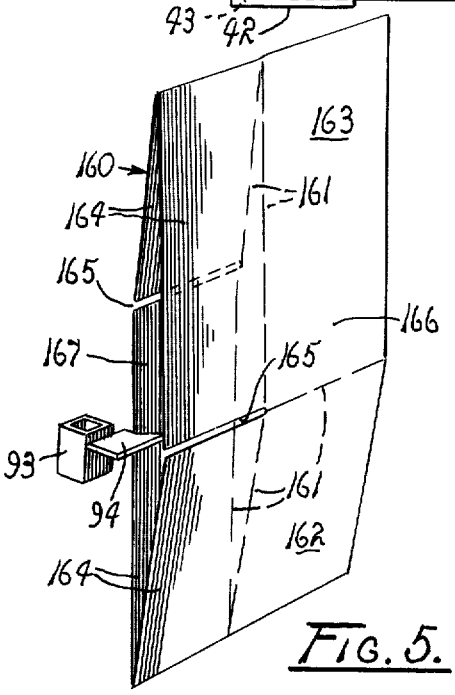
FIG. 5 is a perspective view of a second container component disposed in one operative relationship with respect to a stop finger of the present invention.

The second component feeding magazine 55 is adapted to receive a plurality of second container components 160 folded into the substantially flat configuration shown in FIGS. 3 and 5. The components have score lines 161 defining opposite end walls or portions 162 and opposite side walls or portions 163 for each component when unfolded as shown in FIG. 6. The score lines also define integrally edgewardly extending flap portions 164 borne by the end and side portions of the component. The flap portions are separated by intervening slots 165. Each component in the feeding magazine 55 is folded along remote score lines to position selected end and side portions thereof in substantial facing engagement with predetermined intervening slots disposed in offset relation to each other, as best shown in FIG. 5. The components are stacked in upright relation in the magazine. For illustrative convenience, a leading portion, relative to the direction of feeding in the magazines, of a selected component is indicated at 166 and a trailing portion at 167 in FIG. 5. An assembled container 168 is shown in dashed lines in FIG. 1.

OPERATION

The operation of the described embodiment of the subject invention is believed to be clearly apparent and is briefly summarized at this point. A plurality of first component blanks 149 are deposited in the blank magazine, not shown. A plurality of second container components 160 are stacked in upstanding relation in the feeding magazine 55, as previously described. Each component is positioned so that the slot 165 of the leading portion of the component will be opposite the stop finger 94 when it reaches the component ready station 75 facing in the direction of the container assembly station 46. The control finger 78 is positioned behind the rearwardmost component so as to urge the components toward the ready station. The second component closest to the assembly station is thereby received in the ready station rested against the lower ends 57 of the feed ramps 56 and the upper edges 60 of the brackets 59. The component is retained in this position by the raised lip 63. The component is held in the ready station in a slightly forwardly tilted attitude by the guide arm 74, as best shown in FIG. 2. The confining plate 73 maintains the components, rearwardly of the one in the ready station, from moving into the station until removal of the component from the ready station. The stop finger 94, being horizontally disposed, slides through the adjacent slot 165 of the component and engages the flap portion 164 of the trailing portion 167 thereof so as to retain the component in the position shown in FIG. 5.

The container assembly machine 11 is then operated in the conventional fashion. As will be seen, the upper and lower shafts 17 and 19 operate to control sequential operation of the embodiment 10 of the present invention. The release arm 18 is sequentially, reciprocally rotated by the upper drive shaft 17 to allow the first container component blanks 149 individually to be positioned between the mandrel assembly 15 and the die assembly 25, as shown in FIG. 1. The rotation of the upper drive shaft also operates the discharge arm 127 through the linking rod 133, as will hereafter be described. The mandrel assembly is then thrust longitudinally into the die assembly to fold the blank about the mandrel assembly so as to form the first container component 150 within the die assembly.

Approximately simultaneously, the lower drive shaft 19 rotates the cam wheel 103 thereon to operate the drive mechanism 100. Thus, the cam wheel is rotated to rotate the power take off shaft 102 in a counterclockwise direction, as viewed in FIG. 2. Such movement is transferred to the power transfer shaft 106 by the interconnected lever arm 115, throw arm 116 and linking rod 117 to rotate the power transfer shaft in a clockwise direction as viewed in FIG. 2. Thus, the vacuum cup 120 of the grasping arm 118 is motivated into the second component ready station 75 and into engagement with the end portion 162 of the leading portion 166 of the second container component 160 within the ready station so as to adhere thereto. Meanwhile, the lever arm 18 of the upper drive shaft 17 is again reciprocally operated to permit a blank 149 to be deposited between the mandrel assembly 15 and the die assembly 25 of the machine 11.

As the cam wheel 103 continues to rotate, the follower 104 is caused to rotate the power take off shaft 102 in the reverse or clockwise direction, as viewed in FIG. 2. This driving force is transferred through the lever arm 115, throw arm 116, linking rod 117 and transfer shaft 106 to rotate the grasping arm 118 in a counterclockwise direction as viewed in FIG. 2. Since the vacuum cup 120 is attached to the end portion 162 of the second container component 160, that end portion is pivoted into the container assembly station 46 and into rested engagement with the upper surfaces 41 of the angle iron members 40. During this operation the end portion is pivoted over the raised lip 63 so as to draw the lower portion of the second component upwardly over the lip and into the assembly station. As best illustrated in FIG. 5, as the end portion is drawn from the ready station the slot 165 is pulled about the stop finger 94, if this has not previously occurred. The stop finger thus engages the flap portion 164 of the trailing portion of the component. With the stop finger engaging the rearward flap portion of the component, the rear side portion and extended flap portion of the component is prevented from being drawn into the container assembly station with the remainder of the component. Thus, the component is erected in a substantially rectangular configuration in the assembly station, as shown in FIG. 6.

Subsequently the mandrel assembly 15 is again thrust into the die assembly 25 to fold the blank 149 about the mandrel assembly, as previously described. Simultaneously with folding of the blank, the mandrel assembly forces the preceding first container component 150 from the die assembly through the discharge opening 31. During movement of the component from the die assembly the bottom wall 151 thereof contacts the guide flap 87 and guide finger 90 urging them outwardly into the container assembly station 46. In doing so, the guide flap and the guide finger contact and force outwardly the flap portions 164 of the second container component 160 erected in the assembly station so as to guide insertion of the first container component into the second container component, as shown in FIG. 6. It will be noted that since the stop finger 94 is still engaging the flap portion of the side portion 163, the stop finger also guides the first container component into the interior of the second container component. Furthermore, since the upper surfaces 41 of the right angle members 40 are disposed below the lower die plates 27, as shown in FIG. 3, the lowermost flap portion of the second container component does not interfere with such insertion of the first container component. When the mandrel assembly has completed its forward movement into the die assembly, the first container component first to be formed is sufficiently inserted within the second container component. Full insertion is subsequently accomplished as will be described.

Subsequently, the upper drive shaft 17 is rotated in a counterclockwise direction as viewed in FIG. 1 to permit a new blank 149 to be deposited between the mandrel assembly 15 and die assembly 25. This counterclockwise movement of the shaft causes the lever arm 131, control linkage 132 and linking rod 133 to be operated to motivate the discharge arm 127 from the retracted position shown in FIG. 2 upwardly through the container assembly station 46 to the position shown in FIG. 1. Thus, the assembled container 168 within the station is discharged from the container assembly station and deposited on the conveyor 144 for subsequent handling. As can best be seen in FIG. 1, movement of the discharge arm also motivates the guide panel 141 forwardly to prevent the container from being laterally discharged from the assembly station. It will be noted that the reorientation of the newly assembled container causes the first container component to be gravitationally motivated downwardly within the second container component so that the upwardly extending flap portions 164 of the second container component are free to be folded in sealing relation to the first container component thus forming a lid or cover for the container. This sealing process is handled either manually or mechanically at another station, not shown.

Sequentially, the lower drive shaft 19 is rotated to operate the drive mechanism 100, as previously described, to position the vacuum cup 120 of the grasping arm 118 in engagement with the end portion 162 of the next second container component 160 within the ready station 75 as previously described. It will be noted that reciprocation of the blank release arm causes the discharge arm to be operated. However, the sequence of operation, as described, insures that the only instance that a second component is in the container assembly station during passage of the discharge arm through the station is when the components have been assembled to form the container and it is ready for discharge. Thus, there is no interference between the grasping arm and discharge arm during operation.

Therefore, it will be seen that the present invention obviates the necessity for manual manipulation of container components during assembly by automatically and dependably orienting the components for assembly and ejecting the newly formed containers from the machine and is operated off the existing driving system of the machine so as not to require an auxiliary source of power or drive system.

Although the invention has been herein shown and described in what is conceived to be the most practical and preferred embodiment, it is recognized that departures may be made therefrom within the scope of the invention, which is not to be limited to the illustrative details disclosed.

I claim:

1. In a container assembling machine wherein first components are individually successively inserted into second components in an assembly station along a predetermined path of relative movement and wherein said second components are retained prior to said insertion in a ready station juxtaposed the assembly station and arranged to define predetermined leading and trailing portions, an improvement comprising a stop borne by the machine intermediate the ready and assembly stations and juxtaposed said path of relative movement in a predetermined position to engage the trailing portion of each second component; means for individually successively grasping the leading portion of each second component and pulling said leading portion from said trailing portion to erect said second component in the assembly station in substantial alignment with the path of relative movement; and guide members borne by the machine in juxtaposition to the assembly station bounding said path to introduce said first components into said second components as they are inserted.

2. The improvement of claim 1 in which means are borne by the machine for ejection of assembled first and second components from the assembly station by movement therethrough to draw said assembled components from the stop and guide members.

3. The improvement of claim 1 in which sequencing means interconnect the machine and the grasping means for operating said grasping means in sequence with the operation of the machine to erect a second component in the assembly station prior to said insertion.

4. The improvement of claim 2 in which sequencing means interconnect the machine with the grasping means for operating said grasping means in sequence with operation of the machine to erect a second component in the assembly station prior to said insertion and for operating the ejection means subsequent to said insertion.

5. A container assembling machine comprising a die having sides defining a first component forming chamber with open opposite ends; a mandrel mounted for reciprocal movement into and from an open end of the die; synchronous means for feeding first blanks between the mandrel and the die when the mandrel is moved from the die whereby the blanks are successively carried into the die as the mandrel moves into the die and formed into first components each having a closed bottom conformed to the mandrel and sides continuous with the bottom conformed to the sides of the die and successive first components are ejected from the die into an assembly station by the next succeeding first components formed in the die; a ready station disposed adjacent to the assembly station adapted to contain flatly collapsed second components each having continuous side walls dimensioned to fit flatly outwardly against the sides of the first components, open top and bottom ends, and closure flaps individual to the side walls extended from the top end, said station disposing the collapsed second components in substantially parallel relation to the direction of ejection of the first components from the die; and synchronous means for opening the second components and successively positioning the second components in the assembly station with their top ends in alignment with the die preliminary to ejection of each first component therefrom whereby the first components are ejected from the die into the second components.

6. The machine of claim 5 in which the closure flaps of the second components are separated by slots which terminate at their respective side walls, and when the second components are flatly collapsed in the ready station each has a side wall disposed toward the assembly station, and in which the synchronous means for opening the second components comprises vacuum means successively engageable with said side walls disposed toward the assembly station, and means mounting the vacuum means for reciprocal movement between a position engaged with such a side wall in the ready station and a position in the assembly station whereby such side walls are drawn from their positions in the ready station to the assembly station and the second components opened to receive the first components therein.

7. The machine of claim 5 in which the closure flaps of the second components are separated by slots which terminate at their respective side walls, and when the second components are flatly collapsed in the ready station they are disposed in substantially erect planes and each has an upwardly extended side wall disposed toward the assembly station, and in which the synchronous means for opening the second components comprises vacuum means successively engageable with said upwardly extended side walls, and means pivotally mounting the vacuum means for reciprocal movement between an erect position engaged with an upwardly extended side wall in the ready station and a substantially horizontal position beneath the assembly station whereby such side walls are drawn from their erect positions in the ready station to substantially horizontal positions in the assembly stations.

8. The machine of claim 7 in which the second components when disposed in the ready station each have a slot directly above the closure flap of the side wall engageable by the vacuum means which outwardly overlays an opposite closure flap inwardly of the ready station, and including a stop finger mounted to pass through such slot as the vacuum means pivots the upwardly extended side wall of a second component downwardly to engage said opposite closure flap to hold it in erect position and open the second component to receive a first component.

9. In a container assembling machine, having a container assembly station, and being adapted successively to form first components and subsequently to thrust said components into the assembly station and having a source of second components disposed in feeding relation to the assembly station, said second components individually having endwardly interconnected portions folded into a substantially flat configuration positioning said portions in substantial facing engagement in leading and trailing relation in said source relative to the container assembly station, the improvement comprising a member borne by the machine to define a component retaining lip extending transversely of and in juxtaposition to the source; a confining plate mounted on the source in predetermined spaced relation to the lip and spaced from the container assembly station to define a second component ready station bounded by the lip, confining plate and assembly station; and grasping means borne by the machine for grasping the leading portion of a second component in the ready station and pulling said leading portion from the lip into the assembly station to unfold the second component into first component receiving relation in the assembly station.

10. The improvement of claim 9 in which a slot is provided in a predetermined position in the portion of each second component disposed in leading relation and a stop is affixed on the machine adjacent to the source in juxtaposition to said slot of a second component in the ready station whereby the stop passes through said slot during operation of the grasping means and engages the portion of said second component disposed in trailing relation to insure dependable unfolding of the second component.

11. In a container assembling machine having a die assembly, a container assembly position and being adapted successively to form first components in said die assembly and subsequently to thrust said components through the die assembly along a predefined path of travel into the assembly position and having a source of second components disposed in feeding relation to the assembly position, said second components having endwardly interconnected walls with extended flaps having slots between the flaps and the components folded into a substantially flat configuration to position selected walls in leading and trailing relation and in substantial facing engagement with predetermined slots in offset relation, an improvement comprising guide members pivotally mounted intermediate the die assembly and the assembly position for movement between positions substantially transverse to said path of travel and positions substantially parallel to the path of travel; finger means borne by the machine in the assembly position adjacent to the source and in juxtaposition to a predetermined slot of the adjacent second component; and means, including a grasping member mounted on the machine for movement between an extended, wall engaging position and a retracted component erecting position, for grasping a selected leading wall of said second component and drawing said wall into the assembly position and the predetermined slot about the finger means for engagement of said finger means with the flap of the trailing wall to unfold said second component into first component receiving relation in the assembly position.

12. The improvement of claim 11 in which a container discharge arm is pivotally mounted on the machine adjacent to the assembly position adapted for passage through the assembly position subsequent to adjacent assembly.

13. The improvement of claim 12 in which the machine rotationally mounts a first sequence shaft regulating the supply of first components to the die assembly and the improvement includes a linkage connected in driven relation to the first sequence shaft and connected in sequence controlling relation to the discharge arm.

14. The improvement of claim 13 in which the machine mounts a second sequence shaft and the improvement includes a power take off shaft borne by the machine extending to a position adjaent to the container assembly position, an engaged cam wheel and follower mounted on and operably interconnecting the second sequence shaft and the power take off shaft and a drive transfer assembly interconnects the power take off shaft and the grasping member.

15. In a container assembling machine, having a container assembly station, and being adapted successively to form first components and subsequently to thrust said components into the assembly station and having a source of second components disposed in feeding relation to the assembly station, said second components having endwardly interconnected walls with extended flaps defining slots between the flaps and the components individually folded into a substantially flat configuration to position selected walls in substantial facing engagement in leading and trailing relation in said source relative to the container assembly station with predetermined slots in offset relation, the improvement comprising a member borne by the machine to define a component retaining lip extending transversely of and in juxtaposition to the source; a confining plate mounted on the source in predetermined spaced relation to the lip and spaced from the container assembly station to define a component ready station bounded by the lip, confining plate and assembly station; and grasping means borne by the machine for grasping the leading wall of a second component in the ready station and pulling said wall from the lip into the assembly station to unfold the component into first component receiving relation in the assembly station.

16. The improvement of claim 15 in which a stop is affixed on the machine adjacent to the source and in juxtaposition to a predetermined slot of the second component in the ready station to allow the stop to pass through said slot during operation of the grasping means and to engage the flap of the trailing wall of said component to insure dependable unfolding of the component.

17. The improvement of claim 16 in which a guide arm is mounted on the confining plate extending outwardly over the ready station and assembly station to define a component guiding upper boundary during operation of the grasping means.

18. The improvement of claim 17 in which a tensioned control finger is affixed on the guide arm for extension into the source and engagement with a plurality of said second components to urge them in succession toward the component ready station.

19. In a container assembly machine having coacting mandrel and die assemblies, operable successively to form tray components and thereafter to expel said tray components from the die assembly along a predetermined path of travel into an assembly station, and a source of lid components mounted on the machine in feeding relation to the assembly station and having a lower end, each lid component having pairs of end and side portions defined by intervening score lines and individually mounting edgewardly extending flap portions separated by slots individually endwardly aligned with the score lines and each lid component being folded along remote score lines into a predetermined substantially flat configuration with predetermined slots in offset relation to each other, the improvement comprising a lip borne by the machine intermediate the assembly station and the source at the lower end of the source; a guide plate mounted on the machine in vertically spaced relation to the lower end of the source; a confining plate fastened on the guide plate extending over the source to define a holding station for a plurality of lid components and spaced from the lip and assembly station to define a lid component ready station intermediate the assembly station and holding station; a stop finger affixed on the machine extending from the die assembly bordering the path of travel and in alignment with the adjacent offset slot of a lid component in the ready station; guide members pivotally mounted on the machine intermediate the die assembly and the assembly station and pivotal between normal positions extending substantially transversely into the path of travel and guide positions extending substantially parallel to and bounding the path of travel; a grasping arm pivotally mounted at one of its ends on the machine adjacent to the assembly station and pivotable through the assembly station to the ready station; a vacuum cup borne by the remote end of the arm; a container discharge arm pivotally mounted on the machine adjacent to the assembly station and pivotal through the assembly station from the die assembly and source; and means borne by the machine in connection with the grasping arm and discharge arm for sequential pivoting of said grasping arm to position the cup in engagement with a selected end portion of a lid component in the ready station, retracting of said arm to draw the adjacent offset slot about the stop finger with said stop finger engaging a trailing flap portion of said lid component to erect the component in the assembly station in alignment with the path of travel preceding and in receiving relation to tray component expulsion from the die assembly and subsequently pivoting the discharge arm through the assembly station to discharge the container, assembled by tray component receipt in the lid component, from the assembly station.

20. The improvement of claim 19 in which a guide arm is affixed on the confining plate and extends arcuately outwardly over the ready and assembly stations to define an upper boundary for lid components during erection in the assembly station.

21. The improvement of claim 20 in which a spring tensioned member is secured on the guide arm for tensioned feeding engagement with the plurality of lid components in the source.

22. In a container assembling machine having a coacting mandrel and die, an assembly station disposed in alignment with the die, synchronous means for feeding first blanks between the mandrel and die during operation thereof whereby the blanks are successively formed into first components and successive first components are ejected from the die into the assembly station by the next succeeding first component formed in the die, a ready station disposed adjacent to the assembly station adapted to contain flatly collapsed second components each having continuous side walls dimensioned to fit flatly outwardly against the first components, said station disposing the collapsed second components in substantially parallel relation to the direction of ejection of the first components from the die, the improvement comprising means borne adjacent to the assembly station for successively grasping the second components to unfold them in the assembly station; and means disposed between the die and the assembly station for guiding successive first components ejected from the die into second components in the assembly station.

* * * * *

UNITED STATES PATENT AND TRADEMARK OFFICE

CERTIFICATE OF CORRECTION

PATENT NO. : 3,935,798

DATED : February 3, 1976

INVENTOR(S) : Gerald C. Paxton

It is certified that error appears in the above-identified patent and that said Letters Patent are hereby corrected as shown below:

Column 2, Line 65, delete "top" and insert --- stop ---.

Column 3, Line 42, delete "The" and insert --- A ---.

Column 12, Line 48, delete "adjacent" and insert --- container ---.

Column 12, Line 59, delete "adjaent" and insert --- adjacent ---.

Signed and Sealed this

*twentieth* Day of *April 1976*

[SEAL]

*Attest:*

RUTH C. MASON
*Attesting Officer*

C. MARSHALL DANN
*Commissioner of Patents and Trademarks*